US005134864A

United States Patent [19]

Yabuta et al.

[11] Patent Number: 5,134,864

[45] Date of Patent: Aug. 4, 1992

[54] MOVABLE SINKER IN FLAT KNITTING MACHINE

[75] Inventors: Masahiro Yabuta; Toshinori Nakamori; Minoru Sonomura, all of Wakayama, Japan

[73] Assignee: Shima Seiki Mfg., Ltd., Wakayama, Japan

[21] Appl. No.: 651,824

[22] Filed: Feb. 7, 1991

[30] Foreign Application Priority Data

Feb. 9, 1990 [JP] Japan ..... 2-29795

[51] Int. Cl.[5] ..... D04B 15/06

[52] U.S. Cl. ..... 66/106

[58] Field of Search ..... 66/60 R, 64, 106

[56] References Cited

U.S. PATENT DOCUMENTS 2,893,225 7/1959 Kuntz ..... 66/64

3,362,195 1/1968 Goisis ..... 66/106 X

FOREIGN PATENT DOCUMENTS 609801 6/1978 U.S.S.R. ..... 66/106

*Primary Examiner*—Werner H. Schroeder

*Assistant Examiner*—John J. Calvert

*Attorney, Agent, or Firm*—Edwin E. Greigg; Ronald E. Greigg

[57] ABSTRACT

The invention sets forth a movable sinker which is to be disposed on a needle bed of a flat knitting machine, employing compound needles. The movable sinker is provided with a cam abutting part, a stopper with a pivot hole between the cam abutting part and the stopper, a front tip part includes a guide part with an inclined lower edge which guides the knitting thread to a stopping part. The guide part is so formed that the knitting thread supplied at the time of knitting by this flat knitting machine is securely guided in the hook part of the knitting needle, and the stitch pull-in amount of the carriage at the time of forming a stitch is reduced.

1 Claim, 7 Drawing Sheets

MOVABLE SINKER IN FLAT KNITTING MACHINE

BACKGROUND OF THE INVENTION

The present invention relates to a sinker in a flat knitting machine, and more particularly to a movable sinker in flat knitting machine exhibiting an effective function in a flat knitting machine, using compound needles.

Generally when forming a knit texture by a flat knitting machine, the supplied knitting thread is led to the hook part stopping position of the knitting needle while holding the loop by the sinker and knitting needle disposed at the front tip part of the needle bed, and this supplied knitting thread is stopped at the hook part of the knitting needle, and the knitting needle is drawn back, while the loop is passed over this knitting thread which made up a new loop, and a stitch is formed by knocking over, thereby forming the knit texture successively.

However, when forming various knit textures by a flat knitting machine comprising compound needles, the knitting thread supplied in the hook of the needles may not be securely fed (guided) into the position capable of hooking when knitting due to thickness of different knitting threads, or may be caught by the slider of the compound needles, thereby causing problems in formation of various knit textures.

OBJECT AND SUMMARY OF THE INVENTION

This invention is developed as a result of various studies to solve the above problems, and it is hence a primary object thereof to present a movable sinker in a flat knitting machine capable of securely guiding the knitting thread supplied at the time of knitting into the hook part of the knitting needle, and reducing the stitch pull-in amount of the carriage when forming a stitch.

DETAILED DESCRIPTION OF THE PREFERRED EMBODIMENTS

Figure 1:
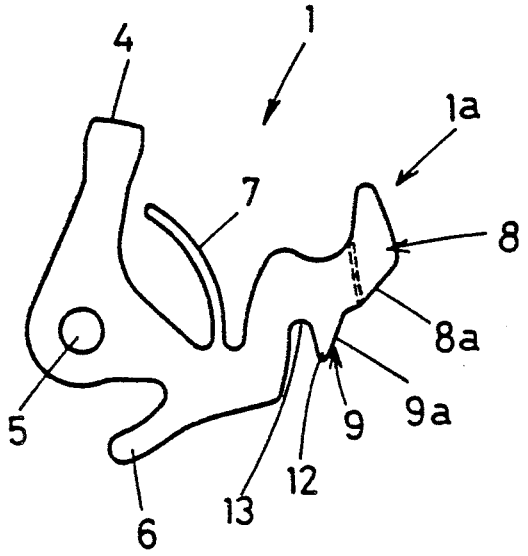
FIG. 1 is a front view of a movable sinker in an embodiment of the invention.

Referring now to the drawings, one of the embodiments of the invention is described in detail below.

Figure 2:
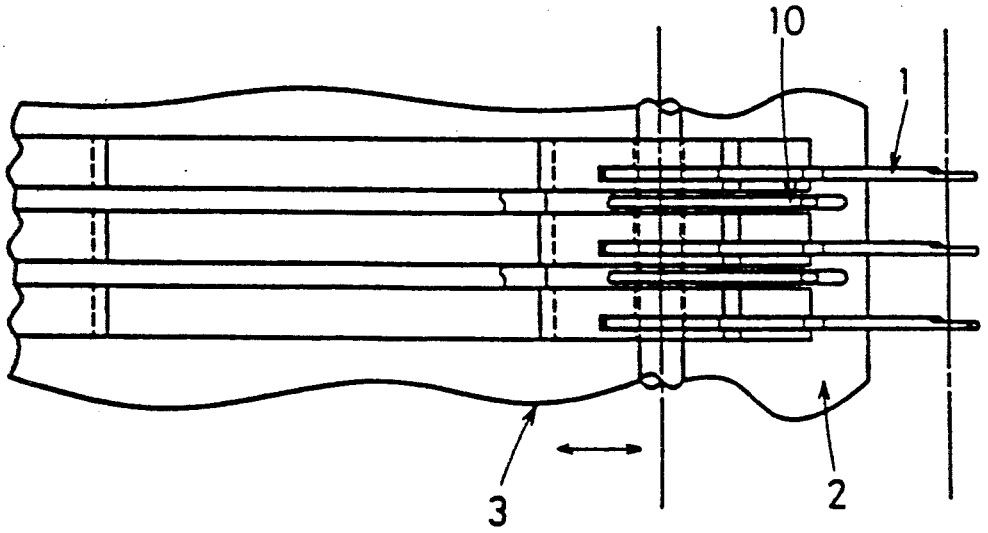
FIG. 2 is a plan view showing a part of the needle bed in a flat knitting machine.
Figure 3:
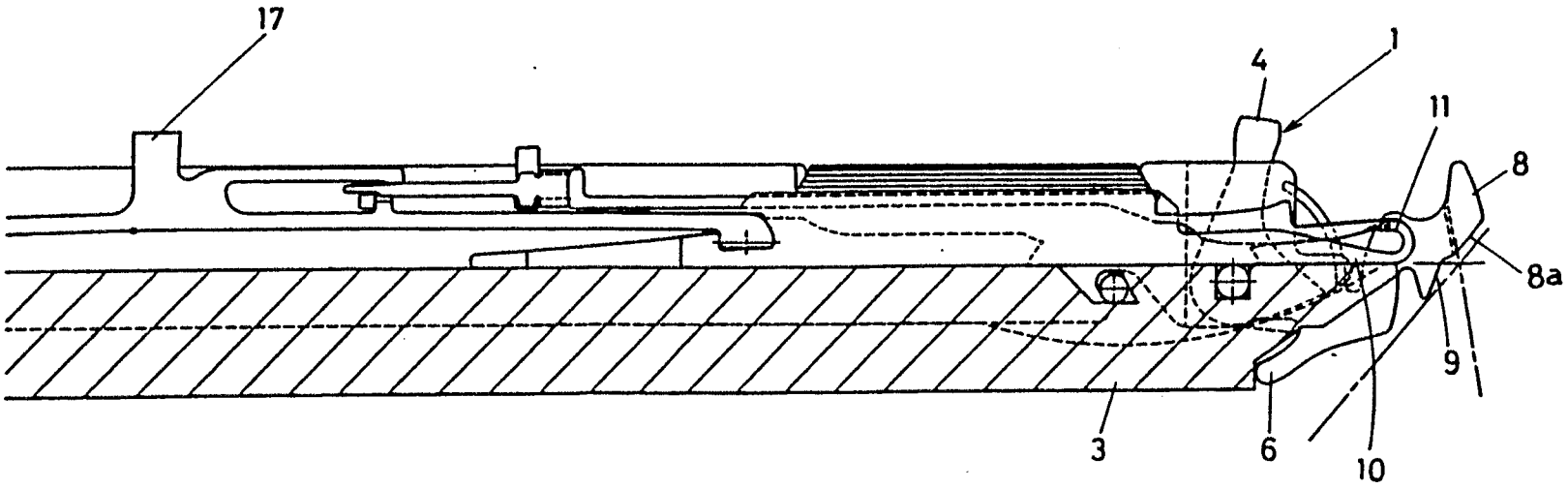
FIG. 3 is an explanatory drawing showing the state of disposing the movable sinker shown in FIG. 1.

FIG. 1 relates to a movable sinker 1 in an embodiment of the invention, and this movable sinker 1 is oscillatably pivoted on a needle bed front tip part 2 of a flat knitting machine as shown in FIG. 2, and is designed to oscillate in the longitudinal direction (arrow direction) of the needle bed 3 by the action of the cam (not shown) of the carriage running laterally on the needle bed. In this movable sinker 1, moreover, an action cam abutting part 4 is formed in the rear upper part as shown in FIG. 1 and FIG. 3, and a pivot hole 5 for pivoting the needle bed front tip part 2 is drilled beneath this action cam abutting part 4. At the lower end of the middle part, a stopper 6 is formed, and when moving (oscillating) ahead of the needle bed of the movable sinker 1, it is designed to abut against the lower end of the needle bed 3. On the other hand, there is a frictional piece 7 extending backward in the upper end part of the middle.

Futhermore, at the front tip part la of the movable sinker 1 which is the essential portion of the invention, a guide part 8 and a knitting thread stopping part 9 are formed. More specifically, at the front tip part la of the movable sinker 1, the guide part 8 for guiding the knitting thread is formed in a manner of a protrusion so that the knitting thread supplied when knitting may be securely stopped at the hook part 11 of the operating knitting needle 10, and this knitting thread supplied at the time of knitting is guided as it abuts against the inclined lower edge 8*a* of this guide part 8. Or when the entire movable sinker 1 moves (oscillates) ahead of the needle bed 3 on the fulcrum of the pivot hole 5, the inclined lower edge 8*a* of the guide part 8 projects ahead of the needle bed 3 from the state before movement as mentioned below.

Beneath the guide part 8, the knitting thread stopping part 9 is formed adjacent to the lower edge 8*a*. This knitting thread stopping part 9 indicates an inclined edge 9*a* formed by a convex part 12 projecting downward, and as the knitting needle 10 retreats, it becomes the stopping position at the sinker side which determines the stitch of the knit formed as being stopped by the hook part 11 of the knitting needle 10. By forming this convex part 12, a concave part 13 is formed behind the convex part 12. The movable sinker 1 is formed in such composition.

Figure 4:
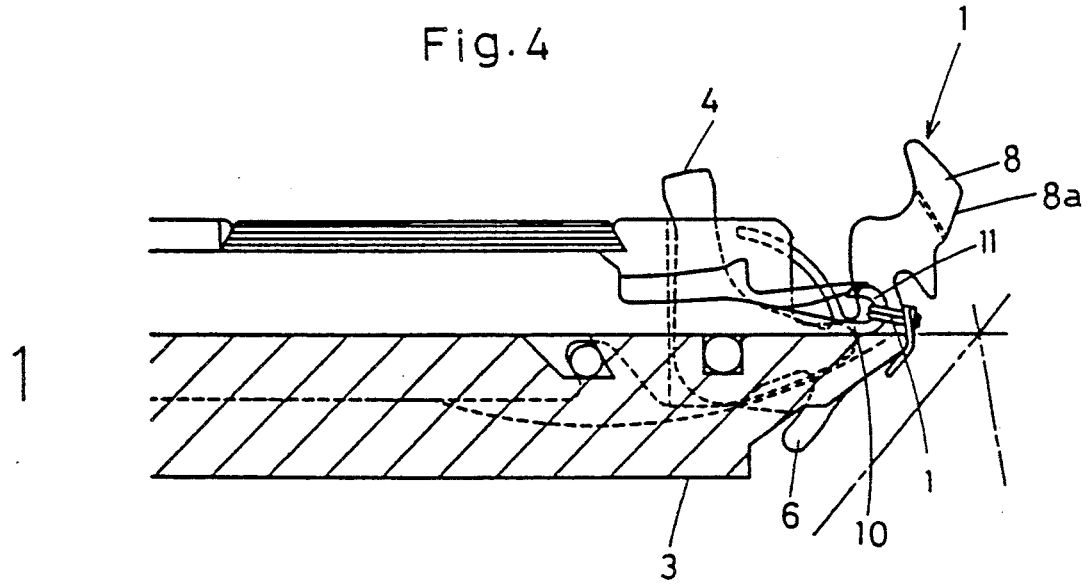
FIG. 4 to FIG. 9 are explanatory drawings showing the state of the sinker, knitting needle and knitting thread in knitting operation.
Figure 5:
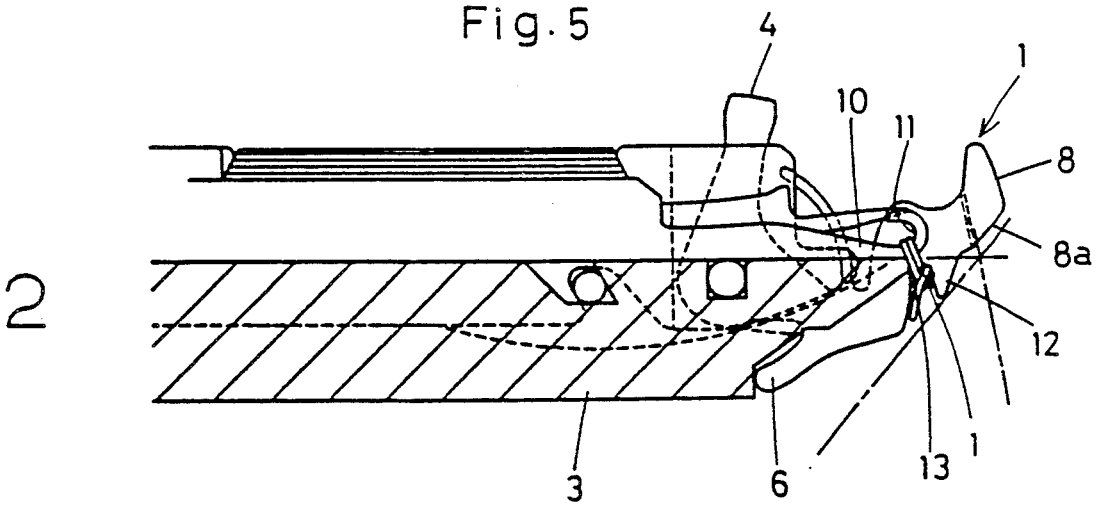

In the lateral knitting machine having such movable sinker 1, as shown in FIGS. 4 to 9 and FIG. 10, when knitting, first of all by the function of the action cam (not shown) of the carriage running laterally on the needle bed 3, the movable sinker 1 moves (oscillates) to the forward side of the needle bed 3 from the state shown in FIG. 4 (see FIG. 5). By this operation, the position of the lower edge 8*a* of the guide part 8 projected and formed at the front tip of the movable sinker 1 is projected ahead of the position of the lower edge 8*a* of the guide part 8 before moving (oscillating) to the forward side of the needle bed 3 (see FIG. 4).

On the other hand, the loop (1) of which one end is stopped by the hook part 11 of the knitting needle 10 acts to push in downward by the action of the movable sinker 1, as the other end is held in the concave part 13 formed by the convex part 12 of the sinker 1.

Figure 6:
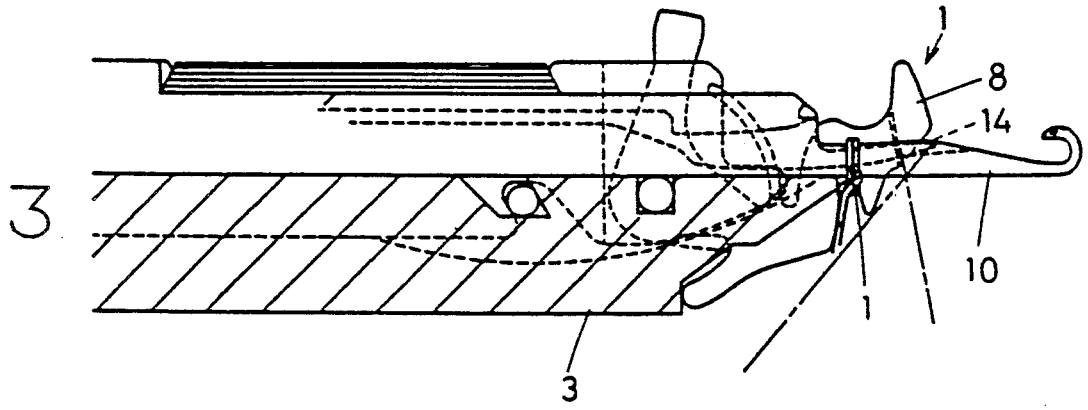
Figure 7:
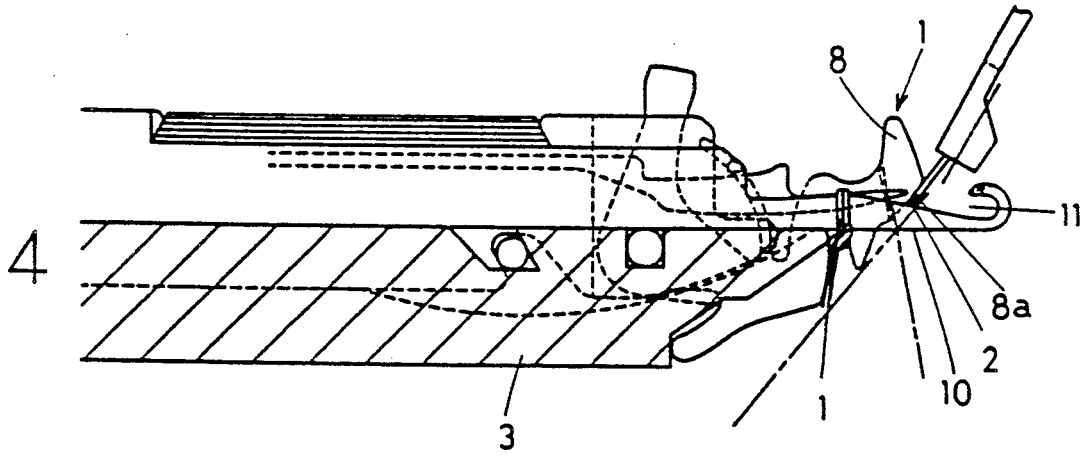
Figure 8:
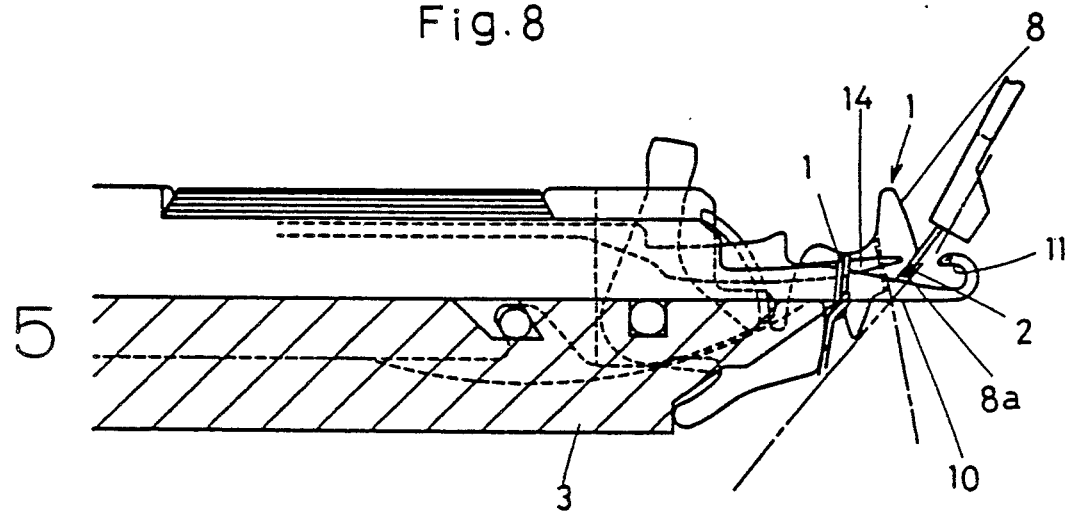
Figure 9:
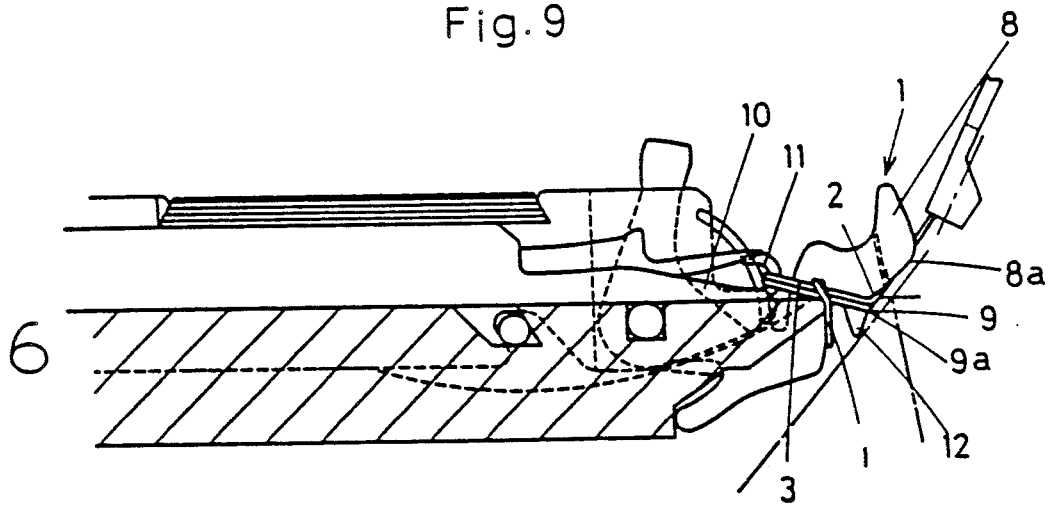

Next, as shown in FIG. 6, when the knitting needle 10 is actuated and projected ahead of the needle bed 3, the loop (1) is stopped on the slider 14 of the knitting needle 10 by this action. In consequence, as shown in FIG. 7, FIG. 8, when the knitting needle 10 slightly draws back, the knitting thread (2) for making up a new loop (3) is supplied beneath the guide part 8 of the movable sinker 1. The supplied knitting thread (2) abuts against the lower edge 8*a* of the guide part 8 projecting ahead of the needle bed 3, and is pushed out forward so that it may be guided to be stopped securely on the hook part 11 of the knitting needle 10, without being caught on the acting slider 14. Next, as shown in FIG. 9, the knitting thread (2) stopped on the hook part 11, moves together with the retreat of the knitting needle 10, and the loop (1) being stopped on the slider is consequently knocked over as riding over the knitting thread (2), thereby forming a new loop (3).

Figure 11:
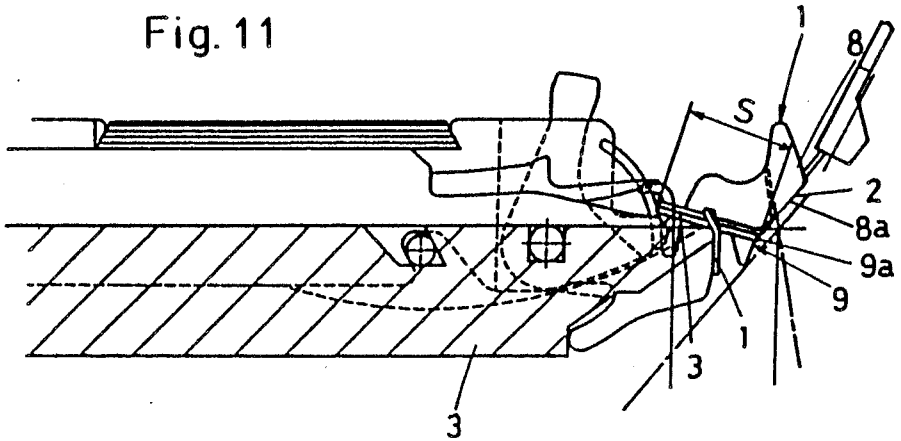
FIG. 11 and 12 are explanatory drawings comparing the working state shown in FIG. 9 with FIG. 12 the working state of a conventional sinker.
Figure 12:
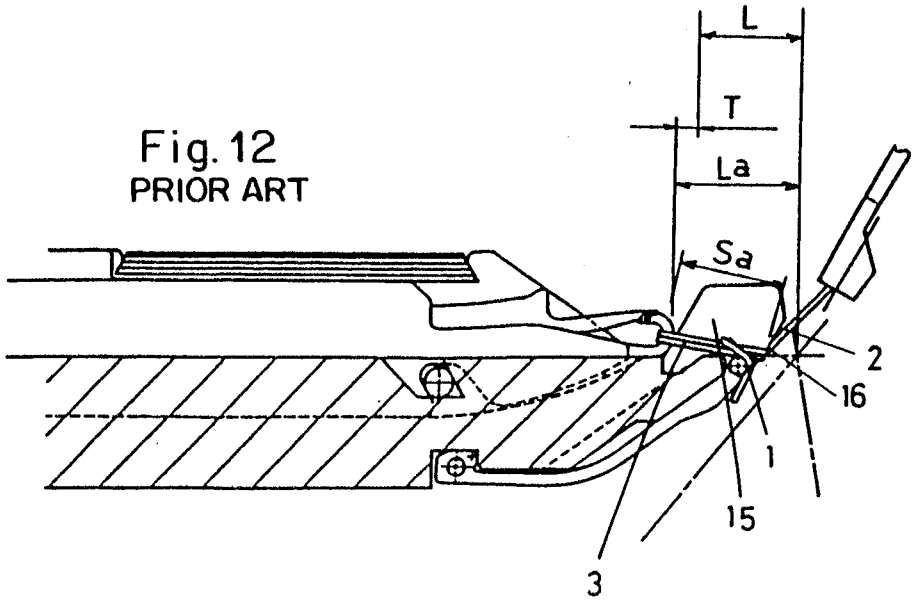
Fig. 12 PRIOR ART

At this time of knock-over, the other end of the knitting thread (2) (new loop (3)) pulled by the hook part 11 of the knitting needle 10 is stopped by the inclined edge 9*a* of the knitting thread stopping part 9 adjacent to the guide part 8 projecting forward as mentioned above. The position of the inclined edge 9*a* of the knitting thread stopping part 9 is located slightly ahead of the stopping position 16 of the knitting thread (2) of the conventional sinker 15 as shown in FIG. 11. Accordingly, the stitch in the same size as in the prior art may be formed in shorter retreat distance of the knitting needle 10 than before.

In other words, supposing the length of the new loop (3) formed by the movable sinker 1 to be S as shown in the drawing and the length of the new loop (2) formed by the conventional sinker 15 to be Sa, provided $S = Sa$, it follows that $La > L$, $La - L = T$, and hence in the case of the movable sinker 1 by this invention, the retreat distance of the knitting needle 10 is shorter by the portion of the distance expressed by T, so that the stitch pull-in amount may be smaller by T as compared with the prior art.

Figure 10:
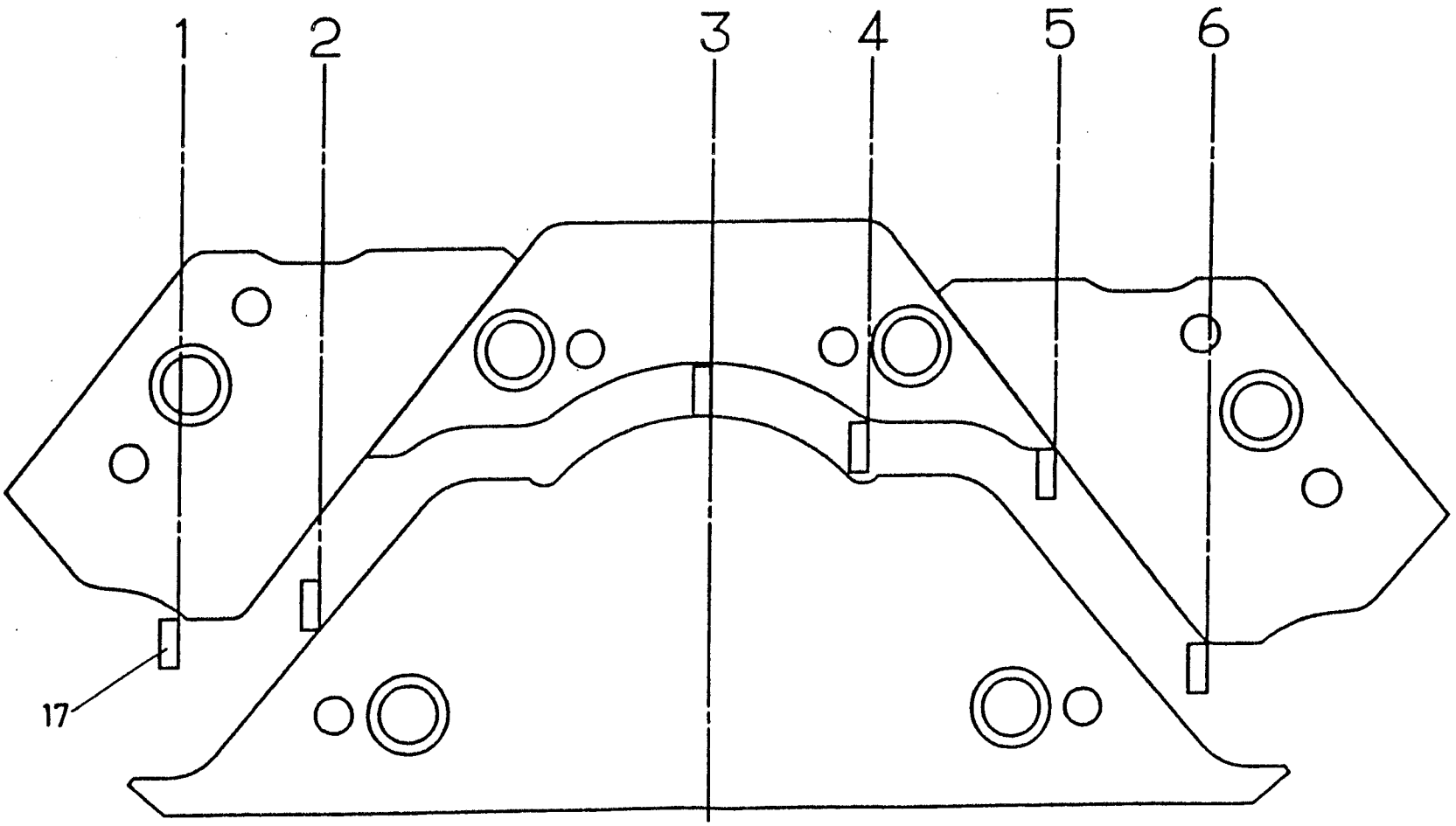
FIG. 10 is an explanatory drawing showing the position at the knitting cam of the needle butt for control of the knitting needle in each state shown in FIG. 4 to FIG. 9.

Meanwhile, FIG. 10 shows the knitting cam for controlling the action of the knitting needle 10, and numerals 1 to 6 denote the positions, in the knitting cam, of the needle butt 17 which is the control part of the knitting needle 10 which is controlled to the positions (1 to 6) shown in FIG. 4 to FIG. 9 respectively.

What is claimed is:

1. A movable sinker for a flat knitting machine, said movable sinker including a cam abutting apart (4), a pivot hole (5) about which the sinker pivots, a stopper (6) below said pivot hole, a front tip part (1*a*) extending outwardly from said stopper (6), said front tip part includes a front guide part (8), a thread stopping part (9) and an inclined lower edge (8*a*) between said front guide part (8) and said thread stopping part (9), a convex part (12) and a concave part (13) between said thread stopping part and said stopper (6), and a frictional piece (7) extending from an upper middle part between said front guide part (8) and said cam abutting part (4), whereby said guide part (8) guides a knitting thread such that said knitting thread is securely engaged to a hook part of an acting needle and the thread is stopped by said thread stopping part during knitting.

* * * * *